United States Patent [19]

Avis

[11] Patent Number: 4,557,801

[45] Date of Patent: Dec. 10, 1985

[54] WET-STRENGTHENED CELLULOSIC WEBS

[75] Inventor: Robert P. Avis, West Chester, Pa.

[73] Assignee: Scott Paper Company, Philadelphia, Pa.

[21] Appl. No.: 642,213

[22] Filed: Aug. 20, 1984

[51] Int. Cl.[4] ..... D21H 5/12

[52] U.S. Cl. ..... 162/157.6; 162/164.6; 162/168.2; 162/178; 162/182; 162/164.1

[58] Field of Search ..... 162/9, 157.6, 164.6, 162/166, 167, 168.2, 182, 183, 178, 100, 164.45

[56] References Cited

U.S. PATENT DOCUMENTS 3,303,184 2/1967 Nordgren ..... 162/178

4,299,654 11/1981 Tlach et al. ..... 162/178

*Primary Examiner*—Peter Chin

*Attorney, Agent, or Firm*—John A. Weygandt; John W. Kane

[57] ABSTRACT

Cationic polygalactomannan gums and water soluble wet strength resins containing an amic acid and at least one other ethylenically unsaturated monomer, are useful in the preparation of products having improved, off-machine dry strength and wet strength properties.

6 Claims, No Drawings

WET-STRENGTHENED CELLULOSIC WEBS

BACKGROUND OF THE INVENTION

1. Field of the Invention

The present invention relates to cellulosic fibrous webs having improved wet and dry strength properties, said webs having been treated with cationic polygalactomannan compositions and an amic acid copolymer.

2. Description of the Prior Art

U.S. Pat. No. 4,391,878 teaches that water soluble copolymers containing the half acid, half amide structure of amic acids can be used to increase the wet strength of paper. Said patent discloses at Column 3 lines 19–33 a means for imparting cationic character to the copolymer which makes it attractive to anionic cellulose fibers for deposition in the wet end of a paper machine.

It is known in the paper making art that negatively charged (anionic) materials can be attached to the negatively charged cellulosic fibers of paper through the use of positively charged (cationic) materials which attach themselves to the negatively charged cellulosic fibers by electrical attraction and either simultaneously or subsequently attach or attract the anionic material on the cellulosic fibrous structure. See, for example, U.S. Pat. No. 3,067,088 granted Dec. 4, 1962 to Hofreiter et al. It is the object of the present invention to provide a material for fixing the wet strength resins of U.S. Pat. No. 4,391,878 to cellulosic fibers, thereby avoiding the necessity of modifying such resins so as to impart to them a cationic character.

SUMMARY OF THE INVENTION

In accordance with the present invention, the amic acid copolymers of U.S. Pat. No. 4,391,878, incorporated herein by reference, are made to appear substantive to cellulose through the use of cationic polygalactomannan gums. The polygalactomannans are generally described in columns 1 and 2 of U.S. Pat. No. 4,301,307 granted June 21, 1977 to DeMartino et al. and assigned to Celanese Corporation also incorporated herein by reference. More particularly, the cationic polygalactomannon compositions for use in the present invention may be described as quaternary ammonium ethers of polygalactomannan gum. Preferred are quarternized ethers of guar gum, which are described, for example, in 1980 TAPPI Retention & Drainage Seminar Notes, pp. 53–63 TAPPI Press 1980. The present invention is illustrated by means of two quarternized ethers of guar gum manufactured by Celanese Corporation, New York, NY: CP-13, the chemical structure of which is shown on page 55 in the aforementioned Seminar Notes and Celbond 22 (CB-22), described as a low charge cationic guar gum at page 59 of the same article. The structure of CP-13 is similar to the quaternary ammonium ethers disclosed and claimed in said U.S. Pat. No. 4,031,307.

When the present inventor sought to apply the general principle of fixing the anionic wet strength resin of U.S. Pat. No. 4,391,878, in particular a maleamic acid copolymer, to the anionic fibers of cellulose by means of a cationic substance, he found that nearly all of the materials which one of ordinary skill in the art to which the present invention pertains would be likely to select were ineffectual in accomplishing this purpose. Those tried to no avail are listed in TABLE A below.

Thus, the beneficial results of the present invention are especially surprising in view of the ineffectiveness of similar or analogous compounds typically used for sizing or web-strengthening purposes in the paper making art.

TABLE A

Cationic materials used with maleamic acid copolymer that gave no significant increase in cured or natural aged wet tensile.

1. Melamine formaldehyde resin (Scott Paper Company)
2. Urea formaldehyde resin (Scott Paper Company)
3. Parez 631NC (American Cyanamid)—glyoxalated polyacrylamide
4. Santores-31 (Monsanto)—polyamine epichlorohydrin
5. National Starch 1957—amphoteric corn starch
6. R.P.C. 1116 (Monsanto)
7. Potato starch (A. E. Staley Mfg. Co.)
8. Dimethylaminopropylmethacrylamide (Texaco)
9. Methacrylamidopropyltrimethylammonium chloride (Texaco)
10. Cato-2 (National Starch)—corn starch
11. Ammonia-epichlorohydrin polymer (Dow, U.S. Pat. No. 3,947,383)

Cationic materials used with maleamic acid copolymer that improved cured wet strength but did not develop significant wet strength on natural aging.

1. Alum
2. Kymene 557H (Hercules) polyamide—polyamine epichlorohydrin
3. Accurac 33 (American Cyanamid)
4. Accurac 33H (American Cyanamid)
5. Delfloc 50 (Hercules)
6. Reten 210 (Hercules) high molecular weight acrylamide copolymer
7. Accostrength 711 (American Cyanamid) polyacrylamide
8. Accostrength 514 (American Cyanamid) polyacrylamide
9. National Starch 1594 corn starch
10. Catomer Q (Richardson Co.)
11. FX-477 (Scott Paper Company, see example XIII)

DETAILED DESCRIPTION OF THE INVENTION

The principles, features and advantages of the invention will be further understood upon consideration of the following specific examples:

EXAMPLE I

Handsheets of paper were prepared employing laboratory apparatus to demonstrate the synergistic effect between ethylene maleamic acid and cationic guar gum. Northern kraft pulp (70% softwood and 30% hardwood) was refined to a Canadian freeness of 450-500 cc. In preparing each handsheet, a pulp slurry was made having a consistency of about 2.2% and containing 60 grams bone dry weight of pulp. The pulp slurry was placed in a British disintegrater which agitates the slurry. In set one (the pulp control) after ten minutes of agitation, the pH of the slurry in the disintegrater was adjusted to 4.0 with a 10% solution of $H_2SO_4$. After 15 minutes, the agitation was stopped and the pulp slurry poured into a proportioning tank of a Noble and Wood apparatus for making handsheets. The consistency of the slurry was adjusted in the tank to yield a handsheet having a basis weight of 20 pounds per ream (2,880 square feet). Several handsheets were then prepared from this slurry by metering a specific quantity of the pulp slurry into the deckle box of the Noble and Wood apparatus along with sufficient water and a final pH adjustment to 4.0 with 10% $H_2SO_4$ to yield an 8 inch by 8 inch handsheet which was then pressed and dried on the pressing and drying section of the Noble and Wood apparatus. Test strips were then prepared from the handsheets and tested for both their dry and wet tensile strengths according to Tappi Standard No. T456M-49 on a Thwing-Albert Tensile Tester. To approximate direct off-machine tensiles the tensile strength tests were performed shortly after the sheets were produced. The tests were then repeated after two and four weeks of natural aging. Test strips of each handsheet were also subjected to high temperature curing for 3 minutes at 300° F. and the wet and dry tensile of the heat cured strips were also determined.

Set two was made in the same manner as set one except a one-half percent solution of CP-13 (a cationic guar gum manufactured by Celanese Corp.) was added to the slurry in the British disintegrater after one minute of mixing resulting in a 2% total solids addition of CP-13 based on fiber solids.

Set three was made in the same manner as set one except a 15.0% solution of the resin made in accordance with Example 2 of said U.S. Pat. No. 4,391,878 hereinafter designated "EMA" was added to the slurry in the British disintegrater after 3 minutes of mixing resulting in a 1.0% total solids addition of EMA based on fiber solids.

Set four was made in the same manner as set one except a 0.5% solution of CP-13 was added after one minute of mixing and a 15% solution of EMA was added after 3 minutes of mixing resulting in 2.0% solids addition of CP-13 and a 1.0% solids addition of EMA based on fiber solids.

Set five was made in the same manner as set one except a 0.5% solution of CB-123 (amphoteric guar gum manufactured by Celanese) was added after one minute of mixing resulting in a 2.0% total solids addition of CB-123 based on fiber solids.

Set six was made in the same manner as set one except a 0.5% solution of CB-123 was added after one minute of mixing and a 15% solution of EMA was added after 3 minutes of mixing resulting in a 2.0% solid addition of CB-123 and a 1.0% solids addition of EMA based on fiber solids.

Set seven was made in the same manner as set one except a 0.5% solution of CB-22 (a cationic guar gum manufactured by Celanese) was added after one minute of mixing resulting in a 2.0% total solids addition of CB-22 based on fiber solids.

Set eight was made in the same manner as set one except a 0.5% solution of CB-22 was added after one minute of mixing and a 15% solution of EMA was added after three minutes of mixing resulting in a 2.0% solids addition of CB-22 and a 1.0% solids addition of EMA based on weight of fiber solids.

The results of the eight sets of Example 1 are given in Table I.

SIGNIFICANCE

It can be seen from Table I that only slight gains in wet tensile are obtained when 2.0% CP-13 is added to the pulp furnish without EMA (set 2) and when 1.0% EMA is added to the pulp furnish without CP-13 (set 3). Set four shows the synergistic effect of sequentially adding both 2.0% CP-13 and 1.0% EMA to dramatically improve the wet strength properties of handsheets compared to sets 1, 2 and 3.

Although less effective than CP-13, the guar gums CB-123 and CB-22 will also provide a synergistic effect with EMA (set 6, vs. sets 1 and 5; set 8 vs. sets 1 and 7).

Table I represents the only type of chemicals found by the present invention which will retain EMA on the fiber to provide significant off machine wet tensile, cured wet tensile and natural aging wet tensile.

EXAMPLE II

Set one, pulp control, was made in the same manner as set one in Example I.

Set two was made in the same manner as set two in Example I, except a 2% solids addition of FX-477 (a cationic dye fixative resin described in example XIII) replaced CP-13.

Set three was made in the same manner as set four in Example I except that a 2% solids addition of FX-477 replaced CP-13 in order to aid retention of the EMA.

Set four was made in the same manner as set four in Example I.

EXAMPLE III

Set one, pulp control, was made in the same manner as set one in Example I.

Set two was made in the same manner as set two in Example I except that a 2% solids addition of Accurac 33 (cationic polymer manufactured by American Cyanamid) replaced CP-13.

Set three was made in the same manner as set four in Example I except that a 2% solids addition of Accurac 33 replaced CP-13 in order to aid retention of the EMA.

Set four was made in the same manner as set two in Example I except that a 2% solids addition of Accostrength 711 (cationic polymer made by American Cyanamid) replaced CP-13.

Set five was made in the same manner as set four in Example I except that a 2% solids addition of Accostrength 711 replaced CP-13 in order to aid retention of the ethylene maleamic acid.

Set six was made in the same manner as set two in Example I except that a 2% solids addition of Delfloc 50 (cationic polymer made by Hercules) replaced CP-13.

Set seven was made in the same manner as set four in Example I except that a 2% solids addition of Delfloc 50 replaced CP-13 in order to aid retention of the EMA.

SIGNIFICANCE

Tables II and III show that the cationic polymers FX-477, Accurac 33, Accostrength 711 and Delfloc 50 are capable of retaining some EMA on the fiber to produce heat cured wet strength but provide little off machine or natural age wet tensile. In other words, no wet strength is produced without heating the paper.

Other materials used in combination with EMA that provide heat cured tensile with little off machine or natural aging wet tensile development are Accurac 33H (American Cyanamid), Accostrength 514 (American Cyanamid), National Starch 1594, Reten (Hercules), and alum.

EXAMPLE IV

Set one, pulp control was made in the same manner as set one in Example I.

Set two was made in the same manner as set two in Example I except that 2.0% solids addition of CB-11 (anionic guar gum, Celanese) replaced CP-13.

Set three was made in the same manner as set four in Example I except that 2.0% solid addition of CB-11 replaced CP-13 prior to the addition of EMA.

Set four was made in the same manner as set two in Example I except that a 2% solids addition of cationic melamine-formaldehyde resin replaced CP-13.

Set five was made in the same manner as set four in Example I except that a 2% solids addition of cationic melamine-formaldehyde replaced CP-13 prior to the addition of ethylene maleamic acid.

Set six was made in the same manner as set four in Example I.

SIGNIFICANCE

The data in Table IV shows that anionic guar gum is not effective with EMA (sets 2 vs 3) and that melamine formaldehyde wet strength resin is far less effective than when used alone when combined in sequential addition with EMA (sets 4 vs 5).

There are a number of cationic compounds that when added sequentially with EMA produce little or no gain or a loss in off machine, heat cured and natural aging wet tensile. They include Santores-31 (Monsanto polyamine epichlorohydrin wet strength resin), urea-formaldehyde resin (according to U.S. Pat. No. 3,275,605), Dow Chemical's ammonia epichlorohydrin resin (U.S. Pat. No. 3,947,383), National Starch Cato 1597, Monsanto RPC 1116, American Cynamid Parez 631 NC, and cationic potato starch (A. E. Staley).

EXAMPLE V

Set one, pulp control was made in the same manner as set one in EXAMPLE I except that the pulp was 100% Northern softwood kraft which was used in all sets of Example V.

Set two was made in the same manner as set four in Example I.

Set three was made in the same manner as set four in Example I except that a 2% solids addition of a cationic urea-formaldehyde resin (U.S. Pat. No. 3,275,605) replaced CP-13 and no EMA was added to the pulp.

Set four was made in the same manner as set three, Example V except that 1% solids EMA was added to the pulp.

Set five was made in same manner as set four in Example I except that 2% solids addition of cationic Kymene 557H resin (Hercules) replaced CP-13 and no EMA was added to the pulp.

Set six was made in the same manner as set five in Example V except that 1% solids EMA was added to the pulp.

Set seven was made in the same manner as set four in Example I except that a 2% solids addition of a cationic base activated Santores-31 resin (Monsanto) replaced CP-13 and no EMA was added to the pulp.

Set eight was made in the same manner as set seven in Example V except that 1% solids of EMA was added to the pulp.

Set nine was made in the same manner as set four in Example I except that a 2% solids addition of a cationic Parez 631NC resin (American Cyanamid) replaced CP-13 and no EMA was added.

Set ten was made in the same manner as set nine in Example V except that 1% solids addition of EMA was added to the pulp.

The data obtained from Example V is shown in Table V.

SIGNIFICANCE

Table V shows that other common cationic wet strength resins such as urea-formaldehyde, Santores-31 and Parez 631NC are adversely effected by the sequential addition of EMA. The addition of EMA to a Kymene 557H treated pulp has little effect on wet strength properties.

EXAMPLE VI

Set one, pulp control, was made in the same manner as set one in Example I except the pH was adjusted to 7.0.

Set two was made in the same manner as set 4 in Example I except pH adjustment to 7.0.

Set three was made in the same manner as set 4 in Example I except the pH was adjusted to 6.0.

Set four was made in the same manner as set four in Example I except the pH was adjusted to 5.0.

Set five was made in the same manner as set four in Example I except the pH was adjusted to 4.0.

The data obtained from Example VI is shown in Table VI.

SIGNIFICANCE

The data in Table VI shows that the sequential addition of CP-13 and EMA will produce off machine, heat cured and natural aging wet strength throughout the pH range of 4.0 to 7.0. However, the CP-13/EMA system is far more effective as the pH is lowered.

EXAMPLE VII

Set one, pulp control, was made in the same manner as set one in Example I.

Set two was made in the same manner as set two in Example I except 1% CP-13 treatment on pulp.

Set three was made in the same manner as set two in Example I.

Set four was made in the same manner as set two in Example I except the CP-13 treatment was increased to 4%.

The data obtained from Example VIII is shown in Table VII.

EXAMPLE VIII

Set one, pulp control, was made in the same manner as set one in Example I.

Set two was made in the same manner as set four in Example I except 0.25% CP-13 was used.

Set three was made in the same manner as set four in Example I.

Set four was made in the same manner as set four in Example I except that 4.0% CP-13 was used.

Set five was made in the same manner as set four in Example I except that 4.0% CP-13 and 0.25% EMA were used.

Set six was made in the same manner as set two in Example I except that 4.0% CP-13 was used.

The data obtained from Example VIII is shown in Table VIII.

EXAMPLE IX

Set one, pulp control, was made in the same manner as set one in Example I.

Set two was made in the same manner as set four in Example I except that 2% EMA was added.

Set three was made in the same manner as set four in Example I.

Set four was made in the same manner as set four in Example I except that 0.5% EMA was added.

Set five was made in the same manner as set four in Example I except that 0.25% EMA was added.

Set six was made in the same manner as set four in Example I except that 0.125% EMA was added.

Set seven was made in the same manner as set four in Example I except that 0.0625% EMA was added.

The data obtained from Example IX is shown in Table IX.

EXAMPLE X

Set one, pulp control, was made in the same manner as set one in Example I except the pulp was 100% Northern softwood kraft which was used in all sets of Example X.

Set two was made in the same manner as set four in Example I except that 1% CP-13 was added.

Set three ws made in the same manner as set four in Example I except that 1% CP-13 and 2% EMA were added.

Set four was made in the same manner as set four in Example I except that 1% CP-13 and 4% EMA were added.

Set five was made in the same manner as set four in Example I except that 1% CP-13 and 8% EMA were added.

Set six was made in the same manner as set four in Example I except that 8% EMA was added.

Set seven was made in the same manner as set four in Example I except that 4% CP-13 and 8% EMA were added.

Set eight was made in the same manner as set four in Example I except that 8% CP-13 and 8% EMA were added.

Set nine was made in the same manner as set eight in Example X except that no CP-13 was added.

The data obtained from Example X is shown in Table X.

EXAMPLE XI

Set one, pulp control was made in the same manner as set one in Example I except the pulp was 100% Northern softwood kraft which was used for all sets of Example XI.

Set two was made in the same manner as set three in Example I except 0.5% EMA was added.

Set three was made in the same manner as set three in Example I.

Set four was made in the same manner as set three in Example I except that 2% EMA was added.

Set five was made in the same manner as set three in Example I except that 4% EMA as added.

Set six was made in the same manner as set three in Example I except that 8% EMA was added.

The data obtained from Example XI is shown in Table XI.

SIGNIFICANCE

The data in Table VII shows that large amounts of CP-13 can be added to pulp without any significant change in wet tensile compared to the pulp control. The data in Table XI shows that large amounts of EMA can be added to pulp with only slight gains in wet tensile compared to the pulp control. Some EMA is retained in the handsheet via entrapment and the 100% Northern softwood kraft used in Example XI is a stronger pulp than the 70%/30% Northern softwood/Northern hardwood kraft used in Example VIII.

The data contained in Tables VIII, IX and X clearly shows the syn-ergistic effect of combining various amounts of CP-13 and EMA.

As may be seen from Tables VIII, IX and X, if a specified amount of Cp-13 is added to the pulp then the amount of EMA can be optimized (using wet tensile as the main criteria). Furthermore, each increase in the amount of CP-13 added permits more EMA to be retained, which results in increased set tensile.

EXAMPLE XII

Set one, pulp control, was made in the same manner as set one in Example I.

Set two was made in the same manner as set two in Example I, except a 1% solids addition of Cato-2 (cationic corn starch from National Starch) replaced CP-13.

Set three was made in the usual manner as set four in Example I, except that a 1% solids addition of Cato-2 replaced CP-13 in order to aid retention of EMA.

SIGNIFICANCE

Table XII shows that cationic corn starch is capable of retaining some EMA on the fiber to produce a small amount of heat cured wet tensile but provides little or no off-machine or natural age wet tensile. In other words, no wet strength is produced without heating the paper.

EXAMPLE XIII 60.6 grams of hexamethylene tetramine, 86.2 grams of ammonium sulfate, 99.2 grams of dicyandiamide, 373.1 grams of 37% formaldehyde and 339.9 grams of water were placed in a three neck flask equipped with a mechanical stirrer, thermometer and condenser. The mixture was agitated for ten minutes prior to heating. Then the mixture was heated over a 30 minute period to a temperature of 175° F. and maintained between 170°–180° F. for 2 hours. The resin was cooled to 140° F. and 43.1 grams of urea was added to the solution and mixed for 10 minutes. Then 18.5 grams of 37% formaldehyde was added to the resin and mixed for 5 minutes. Adjust the pH of the resin to 7.5–8.0 with 68.6 grams of 10% sodium hydroxide solution. Cool the resin to room temperature and readjust pH to 7.5–8.0 range if necessary. The resulting reaction mixture had a viscosity of 20.4 centistokes at 25° C., a pH of 8.0 and a non-volatile solids content of 34.8%. The resin is designated herein as FX477.

It is apparent that other variations and modifications may be made without departing from the present invention. Accordingly, it should be understood that the forms of the present invention described above are illustrative and not intended to limit the scope of the invention.

TABLE I

| Set # | Conditions pH | Conditions % Additive | Conditions % EMA | Off Machine Tensile Wet Oz/In | Off Machine Tensile Dry Oz/In | Off Machine Tensile % Wet/Dry | Cured 3' @ 300° F. Tensile Wet Oz/In | Cured 3' @ 300° F. Tensile Dry Oz/In | Cured 3' @ 300° F. Tensile % Wet/Dry | 2 Week Natural Aging Tensile Wet Oz/In | 2 Week Natural Aging Tensile Dry Oz/In | 2 Week Natural Aging Tensile % Wet/Dry | 4 Week Natural Aging Wet Oz/In | 4 Week Natural Aging Dry Oz/In | 4 Week Natural Aging % Wet/Dry |
|---|---|---|---|---|---|---|---|---|---|---|---|---|---|---|---|
| 1 | 4.0 | — | — | 1.3 | 176.0 | 0.7 | 1.9 | 173.3 | 1.1 | 1.1 | 184.6 | 0.6 | 2.0 | 182.3 | 1.1 |
| 2 | 4.0 | 2 CP-13 | — | 3.9 | 207.3 | 1.9 | 6.0 | 206.7 | 2.9 | 4.6 | 212.0 | 2.2 | 5.3 | 253.1 | 2.1 |
| 3 | 4.0 | — | 1.0 | 2.1 | 172.0 | 1.2 | 6.8 | 183.5 | 3.7 | 1.3 | 182.9 | 0.7 | 3.0 | 202.9 | 1.5 |
| 4 | 4.0 | 2 CP-13 | 1.0 | 54.6 | 207.0 | 26.4 | 74.3 | 239.0 | 31.1 | 52.9 | 243.4 | 21.7 | 65.4 | 253.7 | 25.8 |
| 5 | 4.0 | 2 CB-123 | — | 8.0 | 205.5 | 3.9 | 14.6 | 220.5 | 6.6 | 9.3 | 219.4 | 4.2 | 12.1 | 244.0 | 5.0 |
| 6 | 4.0 | 2 CB-123 | 1.0 | 25.9 | 213.0 | 12.2 | 51.4 | 226.5 | 22.7 | 27.6 | 230.9 | 12.0 | 34.3 | 266.9 | 12.9 |
| 7 | 4.0 | 2 CB-22 | — | 4.3 | 205.5 | 2.1 | 10.4 | 220.0 | 4.7 | 6.3 | 213.7 | 2.9 | 8.9 | 220.6 | 4.0 |
| 8 | 4.0 | 2 CB-22 | 1.0 | 23.9 | 212.0 | 11.3 | 51.3 | 233.5 | 22.0 | 27.1 | 224.6 | 12.1 | 33.4 | 235.4 | 14.2 |

TABLE II

| Set # | Conditions pH | Conditions % Additive | Conditions % EMA | Off Machine Tensile Wet Oz/In | Off Machine Tensile Dry Oz/In | Off Machine Tensile % Wet/Dry | Cured 3' @ 300° F. Tensile Wet Oz/In | Cured 3' @ 300° F. Tensile Dry Oz/In | Cured 3' @ 300° F. Tensile % Wet/Dry | 2 Week Natural Aging Tensile Wet Oz/In | 2 Week Natural Aging Tensile Dry Oz/In | 2 Week Natural Aging Tensile % Wet/Dry | 4 Week Natural Aging Wet Oz/In | 4 Week Natural Aging Dry Oz/In | 4 Week Natural Aging % Wet/Dry |
|---|---|---|---|---|---|---|---|---|---|---|---|---|---|---|---|
| 1 | 4.0 | — | — | 1.1 | 169.3 | 0.6 | 1.9 | 177.0 | 1.1 | 2.0 | 166.0 | 1.2 | 2.4 | 193.0 | 1.2 |
| 2 | 4.0 | 2 FX-477 | — | 1.5 | 174.3 | 0.9 | 5.1 | 184.5 | 2.8 | 3.3 | 160.0 | 2.1 | 2.0 | 190.5 | 1.0 |
| 3 | 4.0 | 2 FX-477 | 1.0 | 3.0 | 179.0 | 1.7 | 49.3 | 202.65 | 24.3 | 8.0 | 180.0 | 4.4 | 9.5 | 204.5 | 4.6 |
| 4 | 4.0 | 2 CP-13 | 1.0 | 58.0 | 233.0 | 24.9 | 80.4 | 256.5 | 31.3 | 60.3 | 245.3 | 24.6 | 74.1 | 244.0 | 30.4 |

TABLE III

| Set # | Conditions pH | Conditions % Additive | Conditions % EMA | Off Machine Tensile Wet Oz/In | Off Machine Tensile Dry Oz/In | Off Machine Tensile % Wet/Dry | Cured 3' @ 300° F. Tensile Wet Oz/In | Cured 3' @ 300° F. Tensile Dry Oz/In | Cured 3' @ 300° F. Tensile % Wet/Dry | 2 Week Natural Aging Tensile Wet Oz/In | 2 Week Natural Aging Tensile Dry Oz/In | 2 Week Natural Aging Tensile % Wet/Dry | 4 Week Natural Aging Wet Oz/In | 4 Week Natural Aging Dry Oz/In | 4 Week Natural Aging % Wet/Dry |
|---|---|---|---|---|---|---|---|---|---|---|---|---|---|---|---|
| 1 | 4.0 | — | — | 2.8 | 204.5 | 1.4 | 5.4 | 194.9 | 2.8 | | | | 3.8 | 193.5 | 2.0 |
| 2 | 4.0 | 2 Accurac 33 | — | 2.8 | 212.0 | 1.3 | 11.8 | 197.5 | 6.0 | | | | 2.8 | 197.5 | 1.4 |
| 3 | 4.0 | 2 Accurac 33 | 2.0 | 6.9 | 213.0 | 3.2 | 54.9 | 210.0 | 26.1 | | | | 13.0 | 199.0 | 6.5 |
| 4 | 4.0 | 2 Acco-Strength 711 | — | 2.9 | 232.0 | 1.3 | 20.8 | 211.0 | 9.9 | | | | 4.3 | 201.1 | 2.1 |
| 5 | 4.0 | 2 Acco-Strength 711 | 2.0 | 2.6 | 201.5 | 1.3 | 26.1 | 201.7 | 12.9 | | | | 5.5 | 204.6 | 2.7 |
| 6 | 4.0 | 2 DelFloc 50 | — | 4.8 | 202.9 | 2.4 | 25.4 | 190.3 | 13.3 | | | | 9.6 | 182.0 | 5.3 |
| 7 | 4.0 | 2 DelFloc 50 | 2.0 | 6.6 | 216.6 | 3.0 | 46.1 | 208.0 | 22.2 | | | | 12.6 | 182.0 | 6.9 |

TABLE IV

| Set # | Conditions pH | Conditions % Additive | Conditions % EMA | Off Machine Tensile Wet Oz/In | Off Machine Tensile Dry Oz/In | Off Machine Tensile % Wet/Dry | Cured 3' @ 300° F. Tensile Wet Oz/In | Cured 3' @ 300° F. Tensile Dry Oz/In | Cured 3' @ 300° F. Tensile % Wet/Dry | 2 Week Natural Aging Tensile Wet Oz/In | 2 Week Natural Aging Tensile Dry Oz/In | 2 Week Natural Aging Tensile % Wet/Dry | 4 Week Natural Aging Wet Oz/In | 4 Week Natural Aging Dry Oz/In | 4 Week Natural Aging % Wet/Dry |
|---|---|---|---|---|---|---|---|---|---|---|---|---|---|---|---|
| 1 | 4.0 | — | — | 1.0 | 162.4 | 0.6 | 2.6 | 175.3 | 1.5 | 3.0 | 160.7 | 1.9 | 1.4 | 173.7 | 0.8 |
| 2 | 4.0 | 2 CB-11 | — | 1.5 | 170.5 | 0.9 | 5.0 | 190.2 | 2.6 | 4.1 | 169.3 | 2.4 | 4.5 | 180.2 | 2.5 |
| 3 | 4.0 | 2 CB-11 | 1.0 | 1.7 | 178.0 | 1.0 | 8.5 | 202.0 | 4.2 | 5.3 | 192.0 | 2.8 | 5.7 | 186.9 | 3.0 |
| 4 | 4.0 | 2 M.F. | — | 70.9 | 216.5 | 32.9 | 90.4 | 240.5 | 37.6 | 73.7 | 237.3 | 31.1 | 88.1 | 270.9 | 32.5 |
| 5 | 4.0 | 2 M.F. | 1.0 | 12.7 | 184.5 | 6.9 | 39.5 | 197.0 | 20.1 | 16.8 | 164.0 | 10.2 | 16.9 | 188.6 | 9.0 |
| 6 | 4.0 | 2 CP-13 | 1.0 | 54.6 | 211.0 | 25.9 | 73.0 | 236.0 | 30.9 | 60.3 | 185.3 | 32.5 | 67.9 | 276.0 | 24.6 |

TABLE V

| Set # | Conditions pH | Conditions % Additive | Conditions % EMA | Off Machine Tensile Wet Oz/In | Off Machine Tensile Dry Oz/In | Off Machine Tensile % Wet/Dry | Cured 3' @ 300° F. Tensile Wet Oz/In | Cured 3' @ 300° F. Tensile Dry Oz/In | Cured 3' @ 300° F. Tensile % Wet/Dry | 2 Week Natural Aging Tensile Wet Oz/In | 2 Week Natural Aging Tensile Dry Oz/In | 2 Week Natural Aging Tensile % Wet/Dry | 4 Week Natural Aging Wet Oz/In | 4 Week Natural Aging Dry Oz/In | 4 Week Natural Aging % Wet/Dry |
|---|---|---|---|---|---|---|---|---|---|---|---|---|---|---|---|
| 1 | 4.0 | — | — | 6.0 | 241.3 | 2.5 | 6.6 | 253.5 | 2.6 | 4.8 | 268.5 | 1.8 | 3.9 | 276.0 | 1.4 |
| 2 | 4.0 | 2 CP-13 | 1.0 | 61.8 | 256.0 | 24.1 | 91.3 | 264.5 | 34.5 | 66.0 | 270.0 | 24.4 | 66.7 | 309.1 | 21.6 |
| 3 | 4.0 | 2 U.F. | — | 32.9 | 237.5 | 13.9 | 114.5 | 267.5 | 41.4 | 67.0 | 273.1 | 24.5 | 80.1 | 292.6 | 27.4 |

TABLE V-continued

| Set # | Conditions pH | % Additive | % EMA | Off Machine Tensile Wet Oz/In | Dry Oz/In | % Wet/Dry | Cured 3' @ 300° F. Tensile Wet Oz/In | Dry Oz/In | Tensile % Wet/Dry | 2 Week Natural Aging Tensile Wet Oz/In | Dry Oz/In | % Wet/Dry | 4 Week Natural Aging Wet Oz/In | Dry Oz/In | % Wet/Dry |
|---|---|---|---|---|---|---|---|---|---|---|---|---|---|---|---|
| 4 | 4.0 | 2 U.F. | 1.0 | 16.4 | 238.5 | 6.9 | 31.4 | 259.5 | 12.1 | 25.6 | 252.0 | 10.2 | 25.3 | 275.4 | 9.2 |
| 5 | 4.0 | 2 KY557H | — | 14.0 | 211.5 | 6.6 | 42.1 | 233.5 | 18.0 | 23.3 | 241.7 | 9.6 | 32.4 | 252.0 | 12.9 |
| 6 | 4.0 | 2 KY577H | 1.0 | 14.5 | 219.0 | 6.6 | 54.5 | 238.0 | 22.9 | 22.3 | 229.7 | 9.7 | 23.4 | 256.0 | 9.1 |
| 7 | 4.0 | 2 SANTORES-31 | — | 23.3 | 224.5 | 10.4 | 82.6 | 248.5 | 33.3 | 35.6 | 241.7 | 14.7 | 42.7 | 253.1 | 16.9 |
| 8 | 4.0 | 2 SANTORES-31 | 1.0 | 19.4 | 224.0 | 8.7 | 64.4 | 253.0 | 25.5 | 25.7 | 256.0 | 10.0 | 28.3 | 266.3 | 10.6 |
| 9 | 4.0 | 2 PAREZ 631 | — | 95.1 | 277.5 | 34.3 | 101.3* | 271.5* | 37.3* | 98.3 | 278.9 | 35.2 | 102.4 | 308.0 | 33.2 |
| 10 | 4.0 | 2 PAREZ 631 | 1.0 | 82.6 | 271.5 | 30.4 | 79.0* | 279.5* | 28.3* | 84.9 | 271.4 | 31.3 | 84.6 | 315.4 | 26.8 |

*Sample heat cured for 30' at 105° C.

TABLE VI

| Set # | Conditions pH | % Additive | % EMA | Off Machine Tensile Wet Oz/In | Dry Oz/In | % Wet/Dry | Cured 3' @ 300° F. Tensile Wet Oz/In | Dry Oz/In | Tensile % Wet/Dry | 2 Week Natural Aging Tensile Wet Oz/In | Dry Oz/In | % Wet/Dry | 4 Week Natural Aging Wet Oz/In | Dry Oz/In | % Wet/Dry |
|---|---|---|---|---|---|---|---|---|---|---|---|---|---|---|---|
| 1 | 7.0 | — | — | 3.3 | 176.0 | 1.9 | 1.0 | 176.0 | 0.6 | 3.6 | 173.3 | 2.1 | 2.3 | 198.0 | 1.2 |
| 2 | 7.0 | 2 CP-13 | 1.0 | 9.4 | 241.9 | 3.9 | 55.6 | 246.0 | 22.6 | 23.3 | 215.3 | 10.9 | 28.5 | 232.6 | 12.3 |
| 3 | 6.0 | 2 CP-13 | 1.0 | 24.0 | 280.0 | 8.6 | 67.3 | 233.0 | 28.9 | 34.7 | 222.7 | 15.6 | 42.6 | 236.0 | 18.1 |
| 4 | 5.0 | 2 CP-13 | 1.0 | 34.0 | 236.6 | 14.4 | 61.1 | 224.0 | 27.3 | 40.9 | 233.3 | 175. | 47.3 | 256.6 | 18.4 |
| 5 | 4.0 | 2 CP-13 | 1.0 | 52.7 | 226.3 | 23.3 | 74.6 | 240.6 | 31.0 | 51.8 | 208.7 | 24.8 | 56.4 | 237.7 | 23.7 |

TABLE VII

| Set # | Conditions pH | % Additive | % EMA | Off Machine Tensile Wet Oz/In | Dry Oz/In | % Wet/Dry | Cured 3' @ 300° F. Tensile Wet Oz/In | Dry Oz/In | Tensile % Wet/Dry | 2 Week Natural Aging Tensile Wet Oz/In | Dry Oz/In | % Wet/Dry | 4 Week Natural Aging Wet Oz/In | Dry Oz/In | % Wet/Dry |
|---|---|---|---|---|---|---|---|---|---|---|---|---|---|---|---|
| 1 | 4.0 | — | — | 2.8 | 197.1 | 1.4 | 5.4 | 184.0 | 2.9 | 2.4 | 177.7 | 1.4 | 3.8 | 188.5 | 2.0 |
| 2 | 4.0 | 1% CP-13 | — | 3.8 | 225.5 | 1.7 | 5.9 | 200.5 | 2.9 | 4.3 | 195.0 | 2.2 | 5.8 | 192.0 | 3.0 |
| 3 | 4.0 | 2% CP-13 | — | 3.8 | 227.0 | 1.7 | 6.8 | 199.0 | 3.4 | 4.4 | 207.5 | 2.1 | 6.4 | 184.5 | 3.5 |
| 4 | 4.0 | 4% CP-13 | — | 4.4 | 224.5 | 2.0 | 6.8 | 195.5 | 3.5 | 4.4 | 191.5 | 2.3 | 5.5 | 192.5 | 2.9 |

TABLE VIII

| Set # | Conditions pH | % Additive | % EMA | Off Machine Tensile Wet Oz/In | Dry Oz/In | % Wet/Dry | Cured 3' @ 300° F. Tensile Wet Oz/In | Dry Oz/In | Tensile % Wet/Dry | 2 Week Natural Aging Tensile Wet Oz/In | Dry Oz/In | % Wet/Dry | 4 Week Natural Aging Wet Oz/In | Dry Oz/In | % Wet/Dry |
|---|---|---|---|---|---|---|---|---|---|---|---|---|---|---|---|
| 1 | 4.0 | — | — | 1.3 | 167.2 | 0.8 | 3.3 | 204.5 | 1.6 | 3.2 | 169.3 | 1.9 | 1.1 | 184.6 | 0.6 |
| 2 | 4.0 | .25% CP-13 | 1.0 | 16.6 | 214.5 | 7.7 | 50.3 | 248.0 | 20.3 | 24.7 | 208.7 | 11.8 | 31.4 | 218.9 | 14.3 |
| 3 | 4.0 | 2.0% CP-13 | 1.0 | 47.8 | 248.0 | 19.3 | 95.0 | 264.5 | 35.9 | 59.3 | 245.3 | 24.2 | 70.7 | 222.3 | 31.8 |
| 4 | 4.0 | 4.0% CP-13 | 1.0 | 55.6 | 237.7 | 23.4 | 94.6 | 272.0 | 34.8 | 63.2 | 236.0 | 26.8 | 73.4 | 240.6 | 30.5 |
| 5 | 4.0 | 4.0% CP-13 | .25 | 32.0 | 235.0 | 13.6 | 61.1 | 269.7 | 22.7 | 43.3 | 229.3 | 18.9 | 45.3 | 213.7 | 21.1 |
| 6 | 4.0 | 4.0% CP-13 | — | 6.7 | 193.5 | 3.5 | 16.4 | 247.0 | 6.6 | 11.8 | 206.0 | 5.7 | 13.6 | 209.1 | 6.5 |

TABLE IX

| Set # | Conditions pH | % Additive | % EMA | Off Machine Tensile Wet Oz/In | Dry Oz/In | % Wet/Dry | Cured 3' @ 300° F. Tensile Wet Oz/In | Dry Oz/In | Tensile % Wet/Dry | 2 Week Natural Aging Tensile Wet Oz/In | Dry Oz/In | % Wet/Dry | 4 Week Natural Aging Wet Oz/In | Dry Oz/In | % Wet/Dry |
|---|---|---|---|---|---|---|---|---|---|---|---|---|---|---|---|
| 1 | 4.0 | — | — | 2.1 | 193.1 | 1.1 | 4.6 | 183.4 | 2.5 | 3.4 | 175.4 | 1.9 | 4.5 | 183.5 | 2.5 |
| 2 | 4.0 | 2 CP-13 | 2.0 | 41.5 | 240.6 | 17.2 | 72.5 | 239.5 | 30.3 | 50.4 | 216.5 | 23.3 | 54.5 | 235.0 | 23.2 |
| 3 | 4.0 | 2 CP-13 | 1.0 | 39.6 | 253.5 | 15.6 | 77.8 | 232.5 | 33.5 | 48.0 | 230.5 | 20.8 | 50.3 | 227.5 | 22.1 |
| 4 | 4.0 | 2 CP-13 | 0.5 | 34.9 | 229.0 | 15.2 | 66.7 | 220.5 | 30.2 | 45.5 | 213.0 | 21.4 | 46.4 | 234.5 | 19.8 |

TABLE IX-continued

| Set # | Conditions pH | % Additive | % EMA | Off Machine Tensile Wet Oz/In | Dry Oz/In | % Wet/Dry | Cured 3' @ 300° F. Tensile Wet Oz/In | Dry Oz/In | Tensile % Wet/Dry | 2 Week Natural Aging Tensile Wet Oz/In | Dry Oz/In | % Wet/Dry | 4 Week Natural Aging Wet Oz/In | Dry Oz/In | % Wet/Dry |
|---|---|---|---|---|---|---|---|---|---|---|---|---|---|---|---|
| 5 | 4.0 | 2 CP-13 | 0.25 | 28.9 | 228.0 | 12.7 | 55.1 | 221.5 | 24.9 | 39.4 | 207.0 | 19.0 | 40.8 | 241.5 | 16.9 |
| 6 | 4.0 | 2 CP-13 | 0.125 | 20.5 | 218.3 | 9.4 | 49.0 | 207.5 | 23.6 | 27.5 | 202.0 | 13.6 | 30.4 | 202.5 | 15.0 |
| 7 | 4.0 | 2 CP-13 | 0.0625 | 16.9 | 211.0 | 8.0 | 43.3 | 217.7 | 19.9 | 24.6 | 204.0 | 12.1 | 23.5 | 201.0 | 11.7 |

TABLE X

| Set # | Conditions pH | % Additive | % EMA | Off Machine Tensile Wet Oz/In | Dry Oz/In | % Wet/Dry | Cured 3' @ 300° F. Tensile Wet Oz/In | Dry Oz/In | Tensile % Wet/Dry | 2 Week Natural Aging Tensile Wet Oz/In | Dry Oz/In | % Wet/Dry | 4 Week Natural Aging Wet Oz/In | Dry Oz/In | % Wet/Dry |
|---|---|---|---|---|---|---|---|---|---|---|---|---|---|---|---|
| 1 | 4.0 | — | — | 4.5 | 225.5 | 2.0 | 6.3 | 220.5 | 2.9 | 3.9 | 213.7 | 1.8 | 5.3 | 249.6 | 2.1 |
| 2 | 4.0 | 1 CP-13 | 1.0 | 46.3 | 280.0 | 16.5 | 91.9 | 282.5 | 32.9 | 61.7 | 272.6 | 22.6 | 87.1 | 304.0 | 28.7 |
| 3 | 4.0 | 1 CP-13 | 2.0 | 44.3 | 272.5 | 16.3 | 90.1 | 276.5 | 32.7 | 58.1 | 268.0 | 21.7 | 80.3 | 302.3 | 26.6 |
| 4 | 4.0 | 1 CP-13 | 4.0 | 46.5 | 286.5 | 16.2 | 98.4 | 300.7 | 32.7 | 67.0 | 272.6 | 24.6 | 87.3 | 290.3 | 30.1 |
| 5 | 4.0 | 1 CP-13 | 8.0 | 47.1 | 294.0 | 16.6 | 105.6 | 292.0 | 36.2 | 71.9 | 285.1 | 25.2 | 90.4 | 311.4 | 29.0 |
| 6 | 4.0 | 2 CP-13 | 8.0 | 76.8 | 298.3 | 25.7 | 117.1 | 299.5 | 39.1 | 80.4 | 296.6 | 27.1 | 108.9 | 326.9 | 33.3 |
| 7 | 4.0 | 4 CP-13 | 8.0 | 88.6 | 296.5 | 29.9 | 125.1 | 286.5 | 43.7 | 93.7 | 312.0 | 30.0 | 121.1 | 313.1 | 38.7 |
| 8 | 4.0 | 8 CP-13 | 8.0 | 89.0 | 273.5 | 32.5 | 128.6 | 280,5 | 45.0 | 97.3 | 264.6 | 36.8 | 120.9 | 305.1 | 39.6 |
| 9 | 4.0 | — | 8.0 | 6.9 | 215.0 | 3.2 | 28.3 | 223.0 | 12.7 | 9.9 | 204.0 | 4.9 | 14.4 | 237.7 | 6.1 |

TABLE IX

| Set # | Conditions pH | % Additive | % EMA | Off Machine Tensile Wet Oz/In | Dry Oz/In | % Wet/Dry | Cured 3' @ 300° F. Tensile Wet Oz/In | Dry Oz/In | Tensile % Wet/Dry | 2 Week Natural Aging Tensile Wet Oz/In | Dry Oz/In | % Wet/Dry | 4 Week Natural Aging Wet Oz/In | Dry Oz/In | % Wet/Dry |
|---|---|---|---|---|---|---|---|---|---|---|---|---|---|---|---|
| 1 | 4.0 | — | — | 4.6 | 216.5 | 2.1 | 6.0 | 224.5 | 2.7 | 4.0 | 236.6 | 1.7 | 3.4 | 274.9 | 1.2 |
| 2 | 4.0 | — | .5 | 5.0 | 231.5 | 2.2 | 7.8 | 232.5 | 3.4 | 4.4 | 242.3 | 1.8 | 3.7 | 288.0 | 1.3 |
| 3 | 4.0 | — | 1.0 | 4.3 | 215.5 | 2.0 | 7.9 | 225.0 | 3.5 | 3.4 | 231.4 | 1.5 | 5.0 | 274.3 | 1.8 |
| 4 | 4.0 | — | 2.0 | 4.0 | 233.5 | 1.7 | 9.3 | 228.0 | 4.1 | 3.6 | 236.6 | 1.5 | 6.0 | 273.7 | 2.2 |
| 5 | 4.0 | — | 4.0 | 4.5 | 237.0 | 1.9 | 11.6 | 234.9 | 4.9 | 4.9 | 241.7 | 2.0 | 5.7 | 273.7 | 2.1 |
| 6 | 4.0 | — | 8.0 | 3.9 | 214.0 | 1.8 | 12.6 | 227.5 | 5.5 | 5.6 | 212.6 | 2.6 | 4.6 | 259.4 | 1.8 |

TABLE XI

| Set # | Conditions pH | % Additive | % EMA | Off Machine Tensile Wet Oz/In | Dry Oz/In | % Wet/Dry | Cured 3' @ 300° F. Tensile Wet Oz/In | Dry Oz/In | Tensile % Wet/Dry | 2 Week Natural Aging Tensile Wet Oz/In | Dry Oz/In | % Wet/Dry | 4 Week Natural Aging Wet Oz/In | Dry Oz/In | % Wet/Dry |
|---|---|---|---|---|---|---|---|---|---|---|---|---|---|---|---|
| 1 | 4.0 | — | — | 2.6 | 180.0 | 1.4 | 1.8 | 200.6 | 0.9 | 2.6 | 186.9 | 1.4 | 4.1 | 184.6 | 2.2 |
| 2 | 4.0 | 1.0 CATO-2 | — | 2.0 | 209.1 | 1.0 | 6.6 | 205.0 | 3.2 | 2.1 | 198.9 | 1.1 | 3.3 | 208.6 | 1.6 |
| 3 | 4.0 | 1.0 CATO-2 | 1.0 | 1.9 | 197.1 | 1.0 | 11.9 | 205.7 | 5.8 | 4.0 | 196.0 | 2.0 | 4.9 | 201.7 | 2.4 |

What is claimed is:

1. A cellulosic fibrous paper web containing at least 0.25% based on the weight of the fiber in the web a quaternary ammonium ether of polygalactomannan gum:

wherein the cellulose fibers in said web are chemically modified by a cross-linking reaction with a wet strength resin comprising a water soluble copolymer of a half-acid, half-amide corresponding to the following general formula:

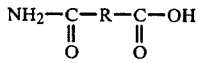

wherein R is a hydrocarbon chain which has radically polymerized with at least one other ethylenically unsaturated monomer, said copolymer being present in an amount of at least 0.1% based on the weight of the fiber in the web.

2. The web in accordance with claim 1 wherein said copolymer is present in an amount equal to 0.1 to 5% based on the weight of the fiber in the web.

3. The web in accordance with claim 1 wherein said quaternary ammonium ether is present in an amount equal to 0.25 to 4% based on the weight of the fiber in the web.

4. The web in accordance with claim 1 wherein said gum is a guar gum.

5. In a method of making a cellulosic fibrous paper web from an aqueous slurry of fibers containing a wet strength resin comprising a water soluble copolymer of a half-acid, half-amide corresponding to the following general formula:

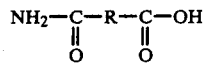

wherein R is a hydrocarbon chain which has radically polymerized with at least one other ethylenically unsaturated monomer, the step of adding at least 0.25% based on the weight of the fiber in the web of a quaternary ammonium ether of polygalactomannan gum to said slurry prior to the addition of said wet strength resin and wherein said copolymer is present in an amount of at least 0.1% based on the fiber in the web.

6. The method according to claim 5 wherein said gum is a guar gum.

* * * * *